US006592123B1

(12) United States Patent
Mattlage et al.

(10) Patent No.: US 6,592,123 B1
(45) Date of Patent: Jul. 15, 2003

(54) CIRCULAR CHESS SYSTEM

(76) Inventors: Alan Roy Mattlage, 6833-A Eastern Ave., Apt. 33, Takoma Park, MD (US) 20912; Martin Raymond Mattlage, 3027 Royal Highlands Dr., St. Louis, MO (US) 63129

( * ) Notice: Subject to any disclaimer, the term of this patent is extended or adjusted under 35 U.S.C. 154(b) by 0 days.

(21) Appl. No.: 09/624,562

(22) Filed: Jul. 24, 2000

(51) Int. Cl.[7] ..... A63F 3/00
(52) U.S. Cl. ..... 273/261; 273/236
(58) Field of Search ..... 273/236, 260, 273/261, 287

(56) References Cited

U.S. PATENT DOCUMENTS 3,851,883 A * 12/1974 Hitchcock
3,917,273 A * 11/1975 Blackwood
4,364,568 A * 12/1982 Tracy
4,553,756 A 11/1985 Linnekin
4,804,191 A 2/1989 Tankersley
4,886,279 A * 12/1989 Taylor ..... 273/261
D306,322 S 2/1990 Kropfl
4,991,856 A 2/1991 Hoerbelt
D356,604 S * 3/1995 Miccio
D376,824 S 12/1996 King

* cited by examiner

*Primary Examiner*—Benjamin H. Layno
*Assistant Examiner*—V K Mendiratta
(74) *Attorney, Agent, or Firm*—Michael L. Greenberg; Greenberg and Lieberman

(57) ABSTRACT

A circular chess system is disclosed wherein an extra diameter is included which through voiding a variable number of spaces changes the play and control of the game. There are three main versions of play, maximal, medial, and minimal with 70, 68 and 66 spaces of play respectively.

5 Claims, 2 Drawing Sheets

Figure 2

A Priori Mobility of Pieces

| | Knight | Bishop | Rook | Queen | Increase % |
|---|---|---|---|---|---|
| Modern Chess | 336 | 280 | 896 | 1456 | n/a |
| Minimal Chess | 380 | 356 | 1074 | 1722 | 19 % |
| Medial Chess | 420 | 424 | 1260 | 2004 | 48 % |
| Maximal Chess | 452 | 476 | 1462 | 2306 | 58 % |

CIRCULAR CHESS SYSTEM

BACKGROUND OF THE INVENTION

1. Field of the Invention

The present invention relates primarily to a circular chess board and playing techniques associated with the board, and more particularly with new methods of defining traditional chess play and strategy.

2. Discussion of Related Art

Chess is a well established strategy game that has been in existence for centuries. Its nearest predecessor Chaturanga is written about in seventh century Sanskrit writings. Due to the nature of trade travel, and expansion, the game was popular in the known world by the fourteenth century. During this period there was not a standard form of the game, and the existing system was much unlike current chess systems. The current chess system is modern chess and the regulations are set by the Federation Internationale des Eschecs (FIDE). These modes of play are established for use on a square game board divided into sixty-four equal squares of alternating dark and light color. There have been variations in the past to both the board, and the rules of play. As described in detail below, there are other circular chess boards and modes of play in current existence, but none like the present invention.

U.S. Pat. No. 4,886,279 issued to Taylor has four spaces in the center that expand in the second row to twelve spaces, in the third row to twenty spaces, and in the outer row to twenty-eight spaces. The shapes of each row of spaces is not congruous with the previous or next row. Unlike the present invention, the "squares" on the board are varying shapes and sizes, there are no void spaces along one diameter of spaces, and the spaces do not extend from the center in a coherent angle fashion.

U.S. Pat. No. 4,553,756 issued to Linnekin, has fourteen alternating bi-color chess spaces extending equally seven each side from a void center space. This system employs one hundred and twelve playable spaces and one center zone designed to facilitate travel of pieces through the middle of the board. Unlike the present invention there are fourteen playable squares per circular row instead of sixteen or eighteen depending on the version of play, it does not have a row of spaces that can be voided along one diameter, and has a center zone.

U.S. Pat. No. 3,851,883 has multiple segments that can be added or taken away as needed, or to accommodate different numbers of players. The parts of the board are arcs that are shaped like rainbows. The arcs vary in size depending on if they are intended to be a center arc or outer arc that fit around the center arcs. Unlike the present invention, this board can be used for more than two players, does not have a diameter that contains void spaces, the center is not a solid part of the board but a cut out, is fourteen spaces in diameter instead of eight, and twenty-two spaces per circular row instead of sixteen or eighteen, depending on mode of play.

U.S. Pat. No. 376,824 issued to King is an ornamental design for a circular chess board. The design consists of a center circle with twelve spaces extending in diameter, and twenty-four spaces on each circular row. Superimposed on the board is a spirograph image. Unlike the present invention, King's device is a design alone, and not a new system of play, it is twelve spaces in diameter, not eight, twenty-four spaces per circular row instead of sixteen or eighteen depending on mode of play, and the device has no void spaces in any diameter.

U.S. Pat. No. 306,322 issued to Kropfl is a design for a circular game board in which the center row of spaces curve in peaks to exhibit a wave like appearance across the board. Kropfl's device is eight spaces in diameter not counting the center circle. Unlike the present invention, this patent is for a design only, not an additional playing system, the board has wave like spaces as one diameter, twenty spaces per circular row instead of sixteen or eighteen depending on mode of play, and does not have void spaces along one diameter row.

U.S. Pat. No. 356,604 issued to Miccio, is a game board that is eight spaces in diameter and each circular row has eighteen spaces. Unlike the present invention, there is no diameter containing void spaces, and it is a design only with no new method of play or new strategy for chess.

U.S. Pat. No. 4,804,191 issued to Tankerslety, is a board and game system in which each quadrant of the circle is equal to the number of spaces and field of play as a regular sixty-four square board. The system of play that is set forth can be exhibited in three separate ways, one quadrant, two quadrant, or four quadrant playing systems. In one quadrant mode of play, you must simultaneously play your piece as though it were in the space it actually is physically located in, and its mirror space directly across the board. However your piece must physically stay in its beginning quadrant. In two quadrant chess, you play your piece in the space that it occupies and in the space that is the mirror image of that space. Additionally, you can move your pieces to the quadrant directly across from the one it is in. Two quadrant playing is set up like traditional chess, but you play your mirror image space as well. Four quadrant chess is a system in which you can play your piece from the space it occupies, or any of the other three spaces that are alike to it in the other quadrants. Unlike the present invention, Tankersley's invention is sixteen spaces in diameter instead of eight, there is no diameter row that contains void spaces, there are thirty-two spaces per circular row instead of sixteen or eighteen, depending on mode of play, and there is no mode of play that is employed in the way that the void spaces are employed in the present invention. This mode of play will be explained in depth later.

U.S. Pat. No. 4,991,856 issued to Hoerbelt is a spirograph shaped game board and a system of play that can accommodate two to five players. Unlike the present invention, the board is not actually circular, but lotus petal shaped, does not have a diameter of spaces which can be voided, has a twenty space arc instead of a eight space diameter, is not intended for only two players, and mode of play is different due to the lack of void spaces, shape of the board, and number of players.

Therefore a need has been established for a chessboard that is circular, with an extra diameter containing voidable spaces, eight spaces in diameter, that employs versatile number of playable spaces for two persons playing chess.

SUMMARY OF THE INVENTION

I. The Board

The board is divided into seventy-two spaces, arranged along intersecting rows,or diameters, and four concentric closed lines or circles. One of the nine intersecting rows contains void spaces. The void spaces do not share a color with any of the other spaces on the board. These void spaces are unplayable depending on the version of the game that is implemented.

II. Mode of Play

There are several modes of play which can be implemented, maximal, medial, minimal, and other. In the maximal version only the two spaces on the outer circle are voided as unplayable. In the medial version the two outer spaces and the two adjacent spaces in the second circle on the diameter of spaces that are possible voids are voided as unplayable. In the minimal version the two spaces on each the outer, adjacent second, and adjacent third circles on the diameter with spaces that can be voided are deemed as unplayable. Other versions can void any number or distribution of void spaces on the single diameter with spaces that can be voided. Spaces can be voided by use of stones, or coins to indicate the non-playable spaces. Players may not cross through or land on any of the voided spaces. Players will choose mode of play at the beginning of the game, and that will be continuous through the game.

BRIEF DESCRIPTION OF THE DRAWINGS

FIG. 2 shows A Priori Mobility of Pieces with Modes of Play Chart.

DETAILED DESCRIPTION OF THE PREFERRED EMBODIMENT

I. The Board

Figure 1:
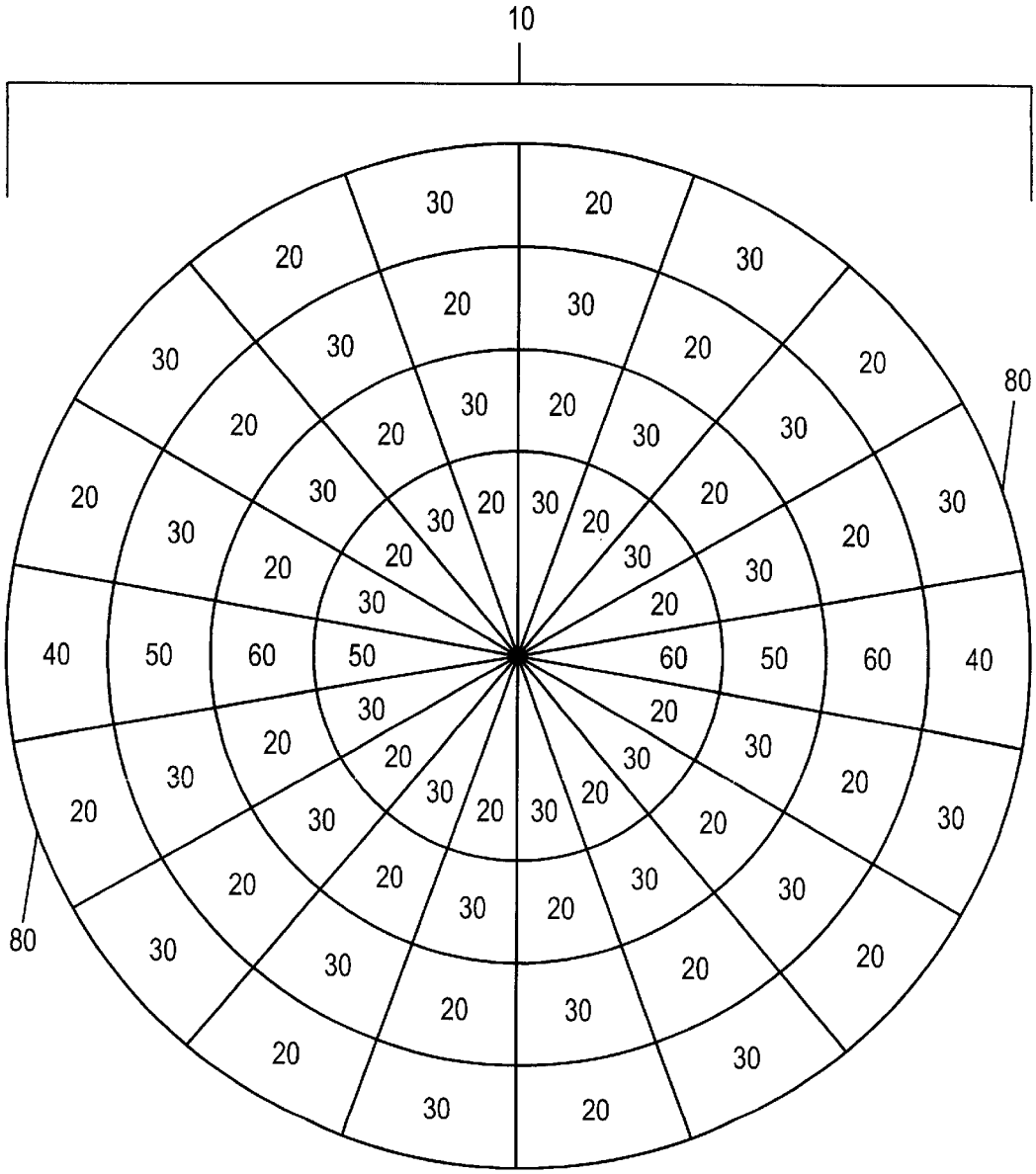
FIG. 1 shows the circular board.

In FIG. 1 we see a top view of the present invention (10). Spaces marked with 20 and 30 respectively are the first and second regions as on a usual chess board. These spaces (20, 30) are terminal non-void spaces. The points marked 40, 50 and 60 respectively are the diameter line that contains void spaces (80), and forms a third region. This diameter line containing void spaces (80) is unique from existing circular chess systems and redefines mode of play by variously limiting the field of play. Void spaces may be indicated by separate colors than the rest of the playing field as numbered. No two adjacent non-void spaces in a circle or row will be the same color.

II. The Mode of Play

Each player is issued a conventional set of chess pieces at the beginning of the game. This set consists of two rooks, two knights, two bishops, a king, a queen and eight pawns per player. Pieces are placed in the outer two circles of the board (10) with the rooks congruous to the diameter row containing voidable spaces (80). White's king rook must be placed on a white space. The pieces are arranged in the first and second regions and in the same order as a traditional chess board. White pieces have the first move. Players may make one move per turn. No two pieces may occupy the same space at the same time, or occupy or move across a void space. A move is completed when a piece has moved legally to another space on the board.

Rooks may move along the diameter, or circular row that they occupy until intersecting another occupied space, and capturing the opposing piece, or landing in a space adjacent to but not replacing a piece of their own.

Bishops may move from the space they occupy on a diagonal, in a congruous movement until intersecting another piece and capturing the piece. Bishops must stop movement at the edge of the board or in intersecting a void space.

The queen may move in diagonal arcs like the bishop, and in rows or diameters like the rook. The king may move one space to any space adjacent, and capture any opposing piece occupying that space, that does not put the king in check.

The spaces that the knight may move are determined by moving two spaces along the diameter and one space along the row, or two spaces along the row and one along the diameter.

The pawns may move one space along the diameter upon which they sit, with exception of the initial move of the game for that side, in which the pawn may move two spaces. When the pawn reaches the center, it is to continue in the same diameter on the other side of the center circle. The pawns capture to the diagonal, regardless of side, toward the center on the originating side of the board and away from the center of the board on the opposing side. If the pawn reaches the outer circle, the pawn can be promoted to the status of any piece other than a king.

Pawns are also permitted to capture en passant. En Passant is a strategy move in which, once an opposing pawn has crossed the center diameter, it may capture a pawn that moves past it with the initial two space move. The capturing pawn ends its move by being placed on the space over which the captured pawn had moved.

A king is in check when it can be captured on the next move, and in checkmate, when it has no feasible escape route from being in check. Winning is achieved by checkmating your opponent or your opponent resigning the game.

Circular chess creates many new variations on possible moves that can be made by each piece. The increase of the mobility of the pieces is shown in FIG. 2, as a 19% increase in mobility in minimal, 48% increase in mobility in medial, and a 58% increase in mobility in maximal. This rate of increased mobility can greatly alter the mode of play for each piece, and redefine traditional strategies. In the present invention, the varying field of play also creates interesting strategy challenges for the novice or experienced player.

In opening of a modern chess game, there are 432 possible different piece arrangements after two movements. However in circular chess' medial version, there are an additional 24 new arrangements per player after the first two moves. Further, 22 of the arrangements that existed previously in modern chess now result in additional spaces being under attack. In the medial version, there are now 46 new arrangements in the first two moves.

Castling is a common move in modern chess to protect one's King, but in circular chess, it becomes a less advantageous strategy. Castling can be preformed only if four conditions are satisfied: 1. the king and rook have not moved from their originating position; 2. no piece occupies the spaces between the rook and king; 3. the king is not under attack; and 4. in castling, the king does not traverse a square that is under attack. The king then can be moved from its originating position two spaces along the first row toward the rook. The rook can then move two or three spaces to the space adjacent to the king on the same row. This set of moves is made at the same time, counting as one move. This is the only time that users can move two pieces at once.

Castling is not as effective in circular chess as it can be in modern chess, because of the increased mobility of the pieces, and the fact that the play is not focused on the center of the board but is spread out along the circular board. In circular chess, the play is spread across the board with still relative close proximity of each piece to its neighboring pieces. This creates new strategic calculations when attempting to place pieces, and new permutations of attack upon their placement.

This circular chess system creates a more challenging game, because it requires players to visualize not only rectilinear, but curvilinear spacial relations. Furthermore, the increased mobility of the pieces is achieved without altering the laws of movement of the pieces, or significantly increasing the area of play. The board allows for an exponentially larger number of chess combinations, a correlatively dramatic increase in the number of possible games, and poses a much greater chess challenge for all chess players, from novice to Grandmasters.

It is contemplated that additional rows could be added, one at a time, maintaining the alternating color sequence. Also, the number of spaces per row could be modified to provide further permutations of the game.

Primarily, the present invention is intended to be a circular chess system with a diameter containing some void spaces and various fields and modes of play. It is to be understood that the present invention is not limited to the sole embodiment described above, but encompasses any and all embodiments within the scope of the following claims.

We claim:

1. A modified chess apparatus, comprising:

a board;

nine diametrical rows on said board, each of said rows having a common point of intersection;

no more than nine spaces forming each of said nine diametrical rows;

at least two of said no more than nine spaces being voided spaces within one of said nine diametrical rows;

wherein said voided spaces within one of said nine diametrical rows are at least two spaces within one of said nine diametrical rows such that said voided spaces within one of said nine diametrical rows are each adjacent to only one or more of said no more than nine spaces in said one of said rows.

2. The modified chess apparatus according to claim 1, wherein said board is circular.

3. The modified chess apparatus according to claim 1, wherein each of said rows extends the diameter of said board.

4. The modified chess apparatus according to claim 1, wherein said at least two voided spaces are unplayable.

5. The modified chess apparatus according to claim 1, wherein said at least two voided spaces are of one said row.

* * * * *